US011112091B2

(12) United States Patent
Xiao et al.

(10) Patent No.: US 11,112,091 B2
(45) Date of Patent: Sep. 7, 2021

(54) LIGHTING FIXTURE

(71) Applicants: OPPLE LIGHTING CO., LTD., Shanghai (CN); SUZHOU OPPLE LIGHTING CO., LTD., Suzhou (CN)

(72) Inventors: Liuhua Xiao, Shanghai (CN); Youfeng Chen, Shanghai (CN); Xiaowei Xu, Shanghai (CN); Gongyu Wu, Shanghai (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 16/687,365

(22) Filed: Nov. 18, 2019

(65) Prior Publication Data

US 2020/0080708 A1 Mar. 12, 2020

Related U.S. Application Data

(63) Continuation of application No. PCT/CN2018/085642, filed on May 4, 2018.

(30) Foreign Application Priority Data

May 23, 2017 (CN) ..... 201720579448.2

(51) Int. Cl.
*F21L 4/00* (2006.01)
*F21V 15/01* (2006.01)
(Continued)

(52) U.S. Cl.
CPC ..... *F21V 15/01* (2013.01); *F21S 8/061* (2013.01); *F21S 9/02* (2013.01); *F21V 3/02* (2013.01);
(Continued)

(58) Field of Classification Search
CPC .... F21V 15/01; F21V 17/164; F21V 21/0808; F21V 21/096; F21V 21/0832;
(Continued)

(56) References Cited

U.S. PATENT DOCUMENTS 5,278,744 A * 1/1994 Geboers ..... F21V 7/04 362/16
6,499,859 B2 * 12/2002 Petzl ..... F21L 4/02 362/183
(Continued)

FOREIGN PATENT DOCUMENTS

CN 201059456 Y 5/2008
CN 101793350 A 8/2010
(Continued)

OTHER PUBLICATIONS

International Search Report of PCT Application No. PCT/CN2018/085642, dated Jul. 25, 2018 with English translation (4p).

*Primary Examiner* — William J Carter
*Assistant Examiner* — Omar Rojas Cadima
(74) *Attorney, Agent, or Firm* — Arch & Lake LLP

(57) ABSTRACT

A lighting fixture is provided in a lighting field. The lighting fixture comprises: a housing assembly and a bottom case assembly. The housing assembly comprises a housing, a light-emitting cover, a reflector and a light source assembly. The housing at least includes a lower end face and a sidewall disposed by extending vertically from the lower end face, to provide a mounting space; and the lower end face is provided with an avoidance section and in communication with the mounting space. The light-emitting cover, the reflector and the light source assembly are sequentially superposed in the mounting space; the light-emitting cover is fixedly connected with the housing; and the light-emitting cover abuts against the lower end face and at least partially closes the avoidance section. The bottom case assembly includes a
(Continued)

bottom case; the bottom case is located above the light source assembly, assembled with the housing, and fixedly connected with the housing to be compressed together tightly and collectively accommodate the reflector and the light source assembly as well as the light-emitting cover.

19 Claims, 19 Drawing Sheets

(51) Int. Cl.

| | |
|---|---|
| ***F21S 8/06*** | (2006.01) |
| ***F21S 9/02*** | (2006.01) |
| ***F21V 3/02*** | (2006.01) |
| ***F21V 7/00*** | (2006.01) |
| ***F21V 7/06*** | (2006.01) |
| ***F21V 17/16*** | (2006.01) |
| ***F21V 21/08*** | (2006.01) |
| ***F21V 21/096*** | (2006.01) |
| ***F21V 23/00*** | (2015.01) |
| ***F21V 23/04*** | (2006.01) |

(52) U.S. Cl.
CPC ..... *F21V 7/0025* (2013.01); *F21V 7/06* (2013.01); *F21V 17/164* (2013.01); *F21V 21/0808* (2013.01); *F21V 21/096* (2013.01); *F21V 23/005* (2013.01); *F21V 23/04* (2013.01); *F21V 23/0471* (2013.01)

(58) Field of Classification Search
CPC ..... F21V 7/0025; F21V 7/06; F21V 23/005; F21V 23/04; F21V 23/0471; F21V 23/0464; F21V 7/0083; F21V 23/0407; F21V 23/0414; F21S 9/02; F21S 43/195; F21Y 2115/10; F21L 4/00; F21W 2111/00; F21W 2121/00
See application file for complete search history.

(56) References Cited

U.S. PATENT DOCUMENTS

| | | | | |
|---|---|---|---|---|
| 7,088,222 | B1 * | 8/2006 | Dueker | B60Q 7/00 340/321 |
| 9,241,391 | B2 * | 1/2016 | Richards | H05B 45/58 |
| 2004/0141311 | A1 | 7/2004 | Chen et al. | |
| 2006/0250789 | A1 * | 11/2006 | Coushaine | F21S 9/02 362/157 |
| 2009/0109677 | A1 * | 4/2009 | Coushaine | F21V 15/01 362/267 |
| 2016/0169483 | A1 * | 6/2016 | Sharrah | F21V 23/0414 362/105 |
| 2017/0151990 | A1 * | 6/2017 | Teitel | F21V 15/01 |

FOREIGN PATENT DOCUMENTS

| | | | |
|---|---|---|---|
| CN | 105299600 | A | 2/2016 |
| CN | 206890362 | U | 1/2018 |

* cited by examiner

LIGHTING FIXTURE

CROSS-REFERENCE TO RELATED APPLICATION

This application is based upon and claims priority to PCT patent application No. PCT/CN2018/085642 filed on May 4, 2018 which claims the priority of Chinese Patent Application No. 201720579448.2, filed on May 23, 2017, the entire contents thereof are incorporated herein by reference.

TECHNICAL FIELD

The present disclosure relates to a lighting field, and more particularly, to a lighting fixture.

BACKGROUND

With continuous development of a lighting technology, lighting fixtures are more and more diversified, including pendant lamps, ceiling lamps, desk lamps, floor lamps, wall lamps, spotlights, and so on. The lighting fixtures has not only played a role limited to illumination, but more often play a decorative role.

Hereinafter, it is described with an emerging night light as an example. Among existing night lights on the market, most of them have a direct-lit structure, which renders a thick housing, unattractive appearance, and poor user experience.

SUMMARY

The present disclosure provides a lighting fixture to overcome the above-described problem of poor user experience due to a thick housing.

Specifically, the present disclosure provides a lighting fixture, comprising: a housing assembly which includes a housing, a light-emitting cover, a reflector and a light source assembly, and a bottom case assembly. The housing, at least includes a lower end face and a sidewall extending vertically from the lower end face, to provide a mounting space; the lower end face being provided with an avoidance section perforating the lower end face in an axial direction and communicating with the mounting space. The light-emitting cover, the reflector, and the light source assembly are superposed in the mounting space in an order from bottom to top. The light-emitting cover is fixedly connected with the housing; and the light-emitting cover abutting against the lower end face and at least partially closing the avoidance section. The bottom case assembly includes a bottom case, where the bottom case is located above the light source assembly, assembled with the housing, and fixedly connected with the housing to be compressed together tightly and collectively accommodate the reflector and the light source assembly as well as the light-emitting cover.

Hereinafter, specific embodiments of the present disclosure will be described in detail in conjunction with the accompanying drawings, so that the above-described and other purposes, features and advantages of the present disclosure are more obvious to those skilled in the art.

BRIEF DESCRIPTION OF THE DRAWINGS

Those ordinarily skilled in the art will clearly understand various other advantages and benefits, through reading the detailed description. The accompanying drawings are provided only for illustrating the present disclosure, rather than limiting the present disclosure. Throughout the accompanying drawings, same reference signs usually denote same components. In the drawings.

DETAILED DESCRIPTION

Figure 1:
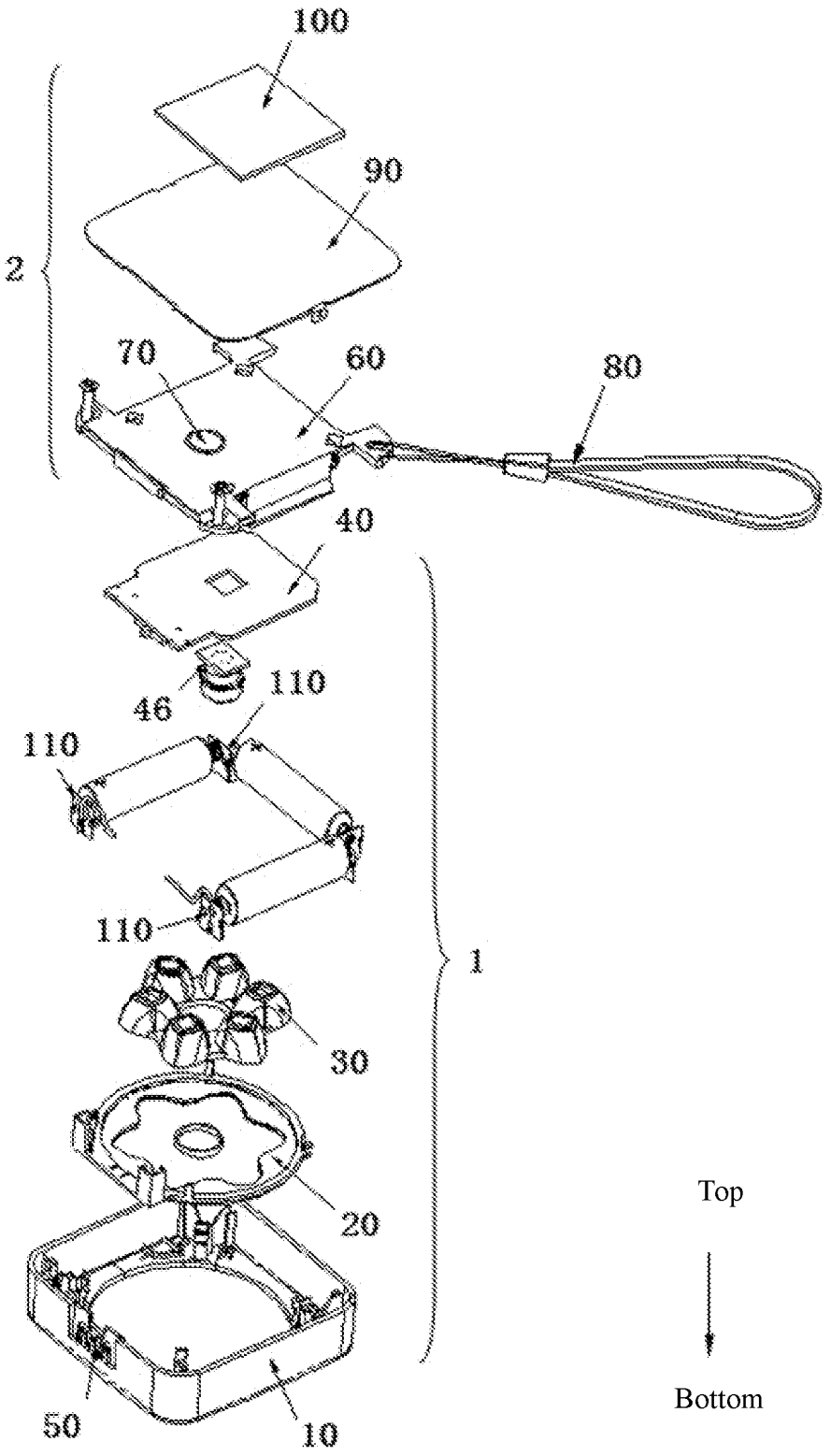
FIG. 1 is a schematic exploded view of parts of a lighting, according to an embodiment of the present disclosure.

Reference will now be made in detail to examples, examples of which are illustrated in the accompanying drawings. The following description refers to the accompanying drawings in which the same numbers in different drawings represent the same or similar elements unless otherwise represented. The implementations set forth in the following description of examples do not represent all implementations consistent with the disclosure. Instead, they are merely examples of apparatuses and methods consistent with aspects related to the disclosure as recited in the appended claims.

The terminology used in the present disclosure is for the purpose of describing particular embodiments only and is not intended to limit the present disclosure. As used in the present disclosure and the appended claims, the singular forms "a," "an," and "the" are intended to include the plural forms as well, unless the context clearly indicates otherwise. It shall also be understood that the term "and/or" used herein is intended to signify and include any or all possible combinations of one or more of the associated listed items.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to a judgment" depending on the context.

Hereinafter, exemplary embodiments of the present disclosure will be described in more detail with reference to the accompanying drawings. Although the exemplary embodiments of the present disclosure are shown in the drawings, it should be understood that the present disclosure may be implemented in various forms and should not be limited by the embodiments explained here. On the contrary, these embodiments are provided so that the present disclosure may be understood more thoroughly, and the scope of the present disclosure may be completely conveyed to those skilled in the art.

Figure 2:
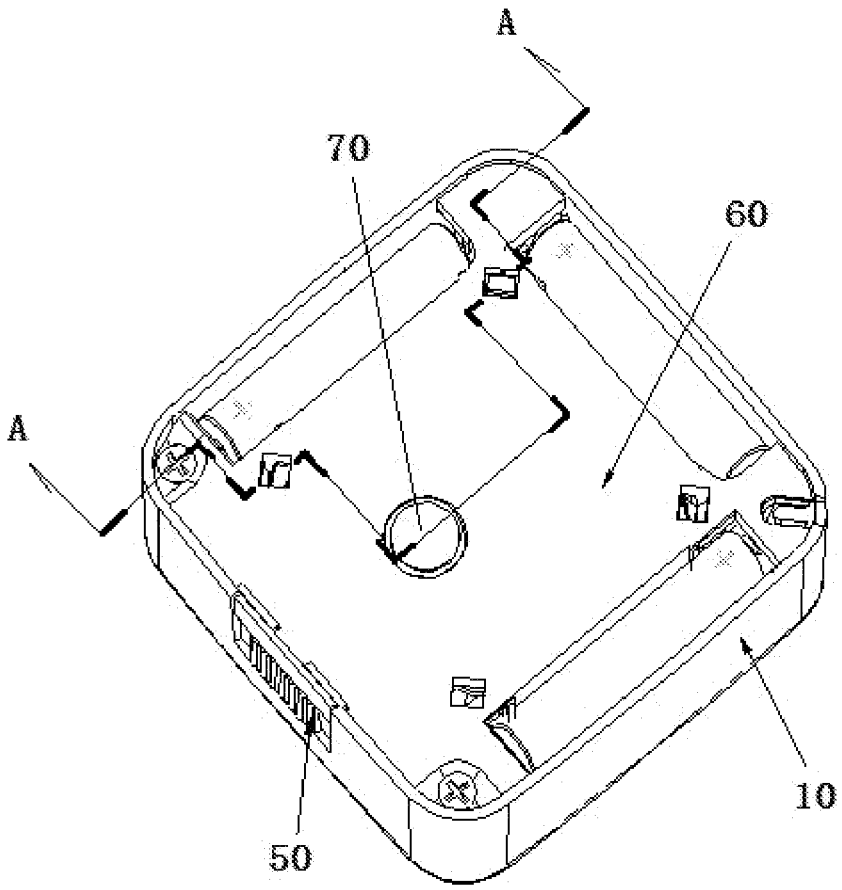
FIG. 2 is a schematic assembly diagram of the lighting fixture without a backplane, according to an embodiment of the present disclosure.
Figure 3A:
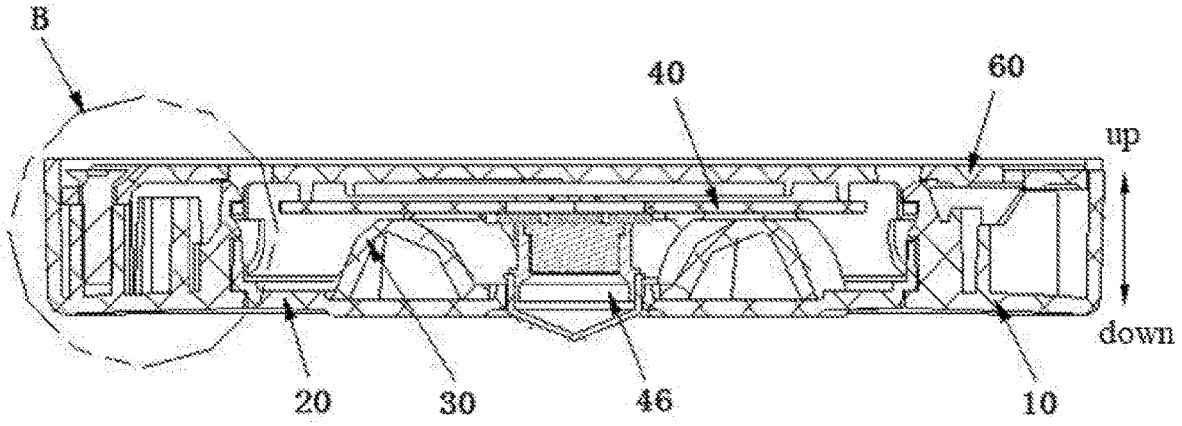
FIG. 3A is a schematic cross-sectional view taken along section line A-A in FIG. 2, according to an embodiment of the present disclosure.
Figure 5:
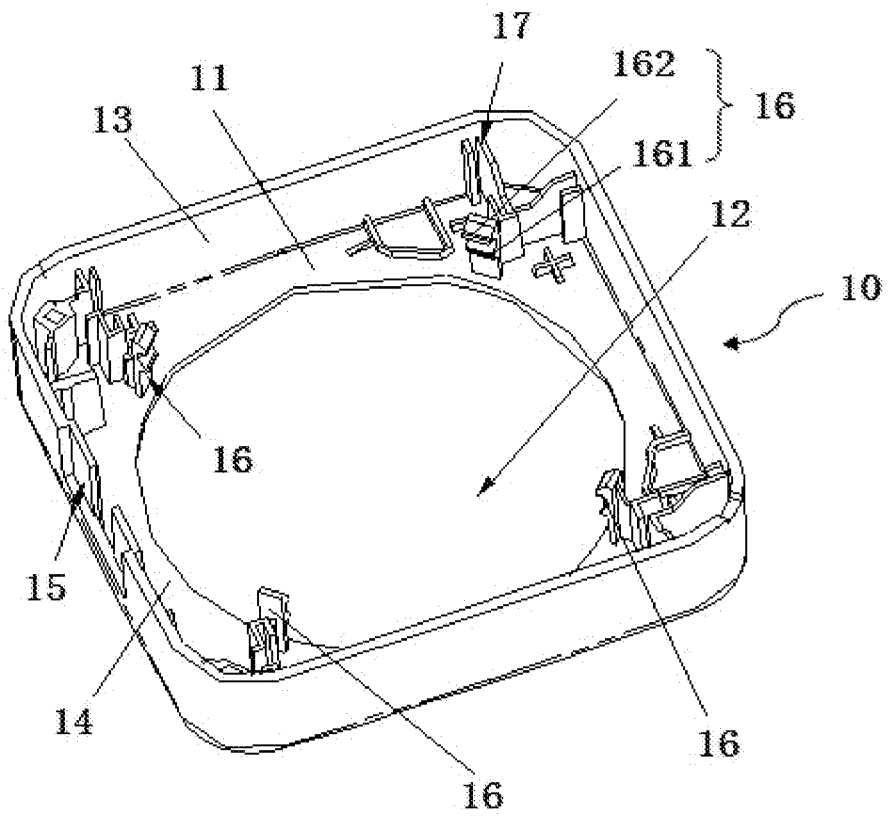
FIG. 5 is a schematic stereoscopic view of a housing, according to an embodiment of the present disclosure.

FIG. 1 is a schematic exploded view of parts of a lighting fixture according to one embodiment of the present disclosure. FIG. 2 is a schematic assembly diagram of the lighting fixture without a backplane. FIG. 3A is a schematic cross-sectional view taken along section line A-A in FIG. 2. FIG. 5 is a schematic stereoscopic view of a housing according to the present disclosure. As shown in FIG. 1, also with reference to FIG. 2 or FIG. 3A, this embodiment is illustrated mainly with FIG. 1. The lighting fixture usually comprises: a housing assembly 1 and a bottom case assembly 2. Wherein, the housing assembly 1 includes a housing 10, a light-emitting cover 20, a reflector 30 and a light source assembly 40. As shown in FIG. 5, the housing 10 includes a lower end face 11 and a sidewall 13 to form a mounting space 14, the sidewall 13 is formed by extending vertically from the lower end face 11; and the lower end face 11 is provided with an avoidance hole 12 perforating the lower end face 11 in an axial direction and communicating with the mounting space. As shown in FIG. 1, also with reference to FIG. 3A, the light-emitting cover 20, the reflector 30 and the light source assembly 40 are superposed in the mounting space 14 in an order from bottom to top; the light-emitting cover 20 is fixedly connected with the housing 10; and the light-emitting cover 20 abuts against the lower end face 11 and at least partially closes the avoidance section 12. The bottom case assembly 2 includes a bottom case 60; the bottom case 60 is located above the light source assembly 40, assembled with the housing 10 and fixedly connected with the housing 10 to be compressed together tightly and collectively accommodate the reflector 30 and the light source assembly 40 as well as the light-emitting cover 20.

More specifically, the housing 10 and the bottom case 60 are assembled into a square shape and have a square accommodating space.

Words "bottom" and "top" according to this embodiment refer to "bottom" and "top" defined by a direction of a view seen by a reader. Of course, those ordinarily skilled in the art will know that, this does not necessarily refer to "bottom" and "top" of the lighting fixture.

The lighting fixture according to the present disclosure uses an ultra-thin design, in which the light-emitting cover 20, the reflector 30 and the light source assembly 40 in the housing assembly 1 are sequentially superposed in the mounting space 14 of the housing 10; the housing assembly 1 and the bottom case assembly 2 are respectively assembled and then fixedly connected together to compress the reflector 30 and the light source assembly 40 tightly, so that an overall structure is assembled firmly and compactly, and a thickness thereof may be as small as a thickness of an AAA battery, which makes the lighting fixture according to the present disclosure have a compact and thin appearance and a good user experience. Accordingly, the lighting fixture according to the present disclosure uses an ultra-thin design, an overall structure is assembled firmly and compactly, and a thickness thereof may be as same as a thickness of an AAA battery, which makes the lighting fixture according to the present disclosure light and thin, and small and exquisite in appearance, with good user experience.

More specifically, in one embodiment, a light-emitting cover 20 is in snap connection with a housing 10; and in other embodiments, a light-emitting cover 20 and a housing 10 may be in a threaded connection, a plug connection, or other fixed connection with each other.

More specifically, in one embodiment, a bottom case 60 and a housing 10 are connected with each other by screws; and in other embodiments, a bottom case 60 and a housing 10 may also be in a snap connection, a plug connection, a threaded connection, or other fixed connection with each other.

Figure 4A:
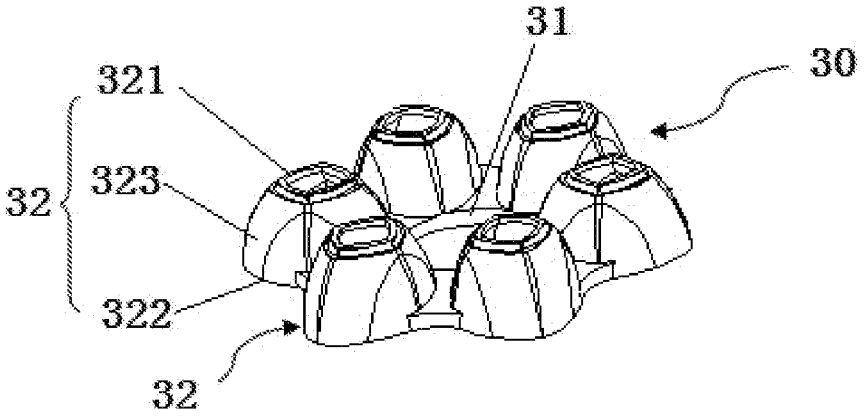
FIG. 4A is a schematic stereoscopic view of a reflector, according to an embodiment of the present disclosure.
Figure 12A:
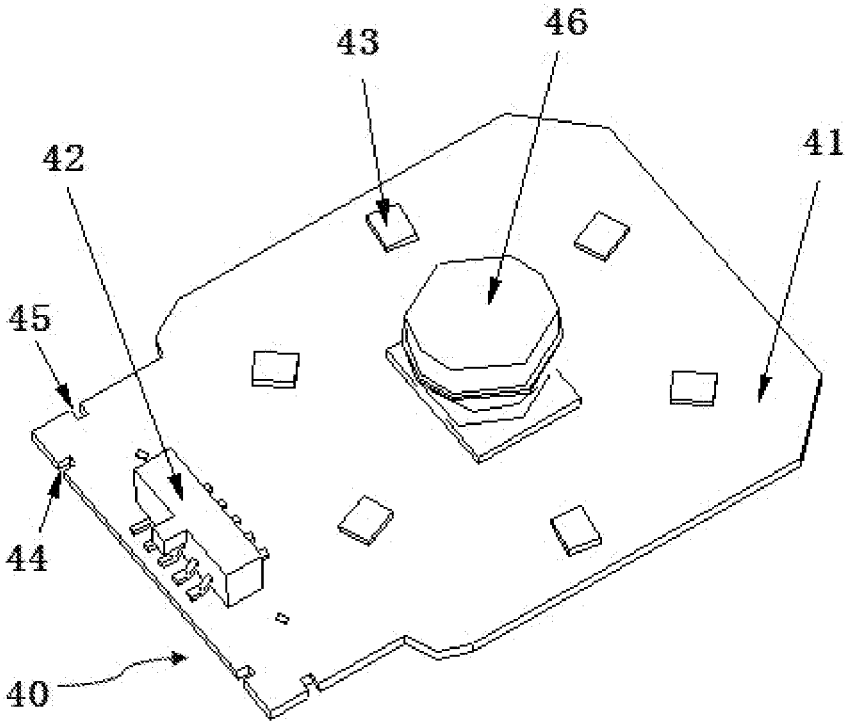
FIG. 12A is a schematic stereoscopic view of a light source assembly, according to an embodiment of the present disclosure.
Figure 13:
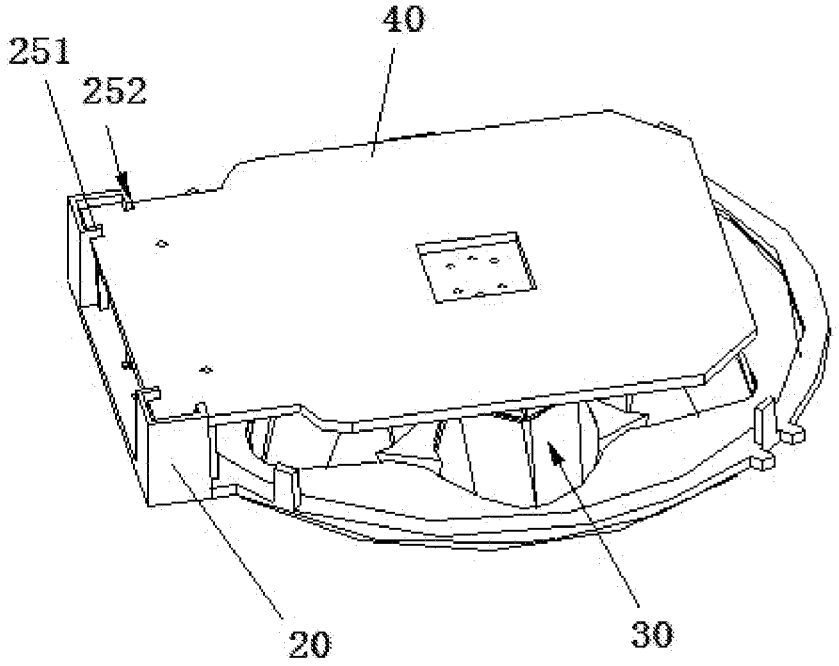
FIG. 13 is a schematic assembly diagram of the light source assembly, the reflector and the light-emitting cover, according to an embodiment of the present disclosure.

FIG. 4A is a schematic stereoscopic view of the reflector according to the present disclosure. FIG. 12A is a schematic stereoscopic view of the light source assembly according to the present disclosure. FIG. 13 is a schematic assembly diagram of the light source assembly, the reflector and the light-emitting cover according to the present disclosure. In this embodiment, as shown in FIG. 4A, the reflector 30 may include a central connecting part 31 and a plurality of sub-reflectors 32. The plurality of sub-reflectors 32 are provided independent of each other and are arranged to surround the central connecting part 31, wherein, each sub-reflector 32 has a light incident port 321, a light emergent port 322 and a sidewall 323 corresponding thereto; the sidewall 323 encloses an optical space in communication with the light incident port 321 and the light emergent port 322; and a sidewall 323 of each sub-reflector 32 is connected with the central connecting part 31. As shown in FIG. 4A, the light source assembly 40 may include: a substrate 41, a drive circuit (not shown), and a plurality of light sources 43. The plurality of light sources 43 are provided on the substrate 41 and electrically connected with the drive circuit. With reference to FIG. 1, a light incident port 321 of each sub-reflector 32 accommodates at least one light source 43.

The reflector 30 provided by the embodiment of the present disclosure may be used in various lighting fixtures. By using the reflector 30, lighting effects of the lighting fixture may be diversified, so as to fabricate the lighting fixture with more aesthetic appearance and more characteristic lighting effects within a low cost range.

Specifically, the connection between the sidewall 323 of the sub-reflector 32 and the annular central connecting part 31 may be a connection between an edge of the light emergent port 322 of the sub-reflector 32 and the annular central connecting part 31, or may also be a connection between a portion other than the edge of the light emergent port 322 of the sub-reflector 32 and the annular central connecting part 31; in a word, the sidewall 323 of the sub-reflector 32 is at least partially connected with the annular central connecting part 31.

Figure 4B:
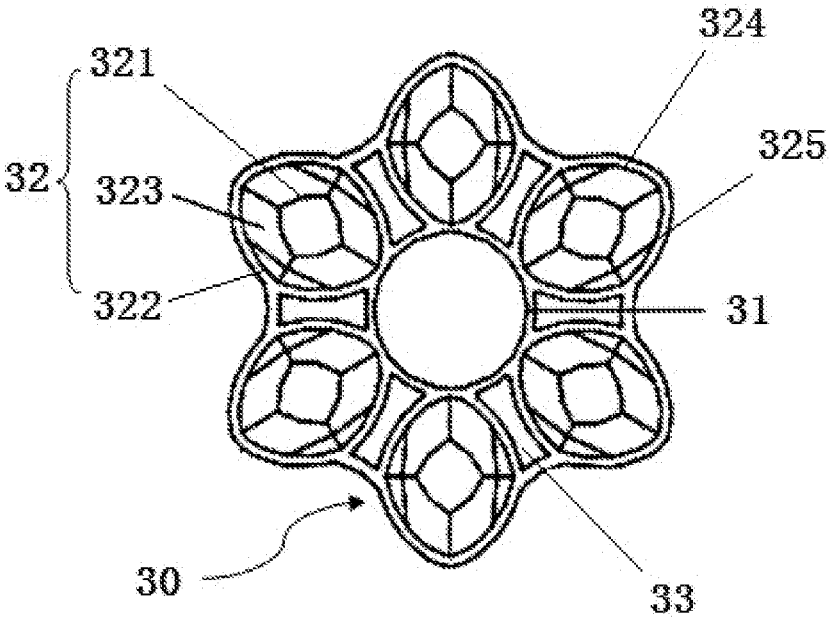
FIG. 4B is a schematic front view of the reflector, according to an embodiment of the present disclosure.

FIG. 4B is a schematic front view of the reflector according to the present disclosure. The sub-reflector 32 may include a plurality of connecting posts 33; and each sub-reflector is connected with an adjacent sub-reflector 32 through a corresponding connecting post 33, so as to form an integral petal reflector.

Specifically, in one embodiment, a sidewall 323 of a sub-reflector 32 is formed by adjoining a plurality of curved surfaces; an intersection edge is formed between adjacent two curved surfaces; and at least two intersection edges simultaneously intersect with an edge of a light emergent port 322 and an edge of a light incident port 321, to respectively form at least two intersection points at the edge of the light emergent port 322 and the edge of the light incident port 321. In other embodiments, a sub-reflector 32 may also be formed by adjoining a curved surface with a flat surface, or in other implementation mode.

In this embodiment, the number of sub-reflectors 32 is six. In other embodiments, the number of sub-reflectors 32 may be any number, and an arrangement of sub-reflectors may be set according to different designs: the sub-reflectors 32 may be arranged at equal intervals to surround an annular central connecting part 31, or may also be arranged at non-equal intervals to surround the annular central connecting part 31. When an integral reflector 30 is formed, the sub-reflectors 32 may not have any connecting post 33 provided therebetween, or may be connected in other mode.

With respect to a shape of the light emergent port 322 of the sub-reflector 32, as shown in FIG. 4B, a first generatrix 324 and a second generatrix 325 of an opening of the sub-reflector 32 are quadratic spline curves; and a shape of the opening of the sub-reflector 32 may be adjusted to a petal shape or other shape by adjusting the first generatrix 324 and the second generatrix 325 of the sub-reflector 32.

Figure 9:
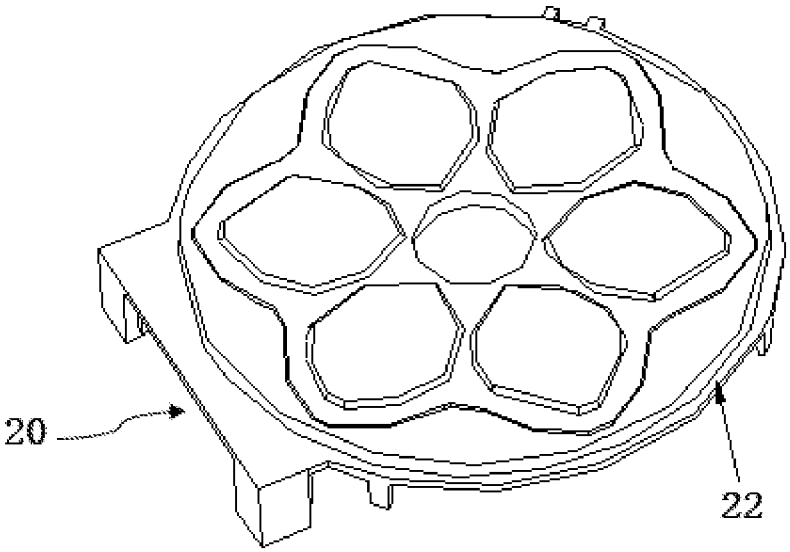
FIG. 9 is a schematic stereoscopic view of a front surface of the light-emitting cover, according to an embodiment of the present disclosure.

FIG. 9 is a schematic stereoscopic view of a front surface of the light-emitting cover according to the present disclosure. In this embodiment, the light-emitting cover 20 is set to a pattern consistent with the shape of the opening of the reflector 30. Further, the pattern is provided at a surface of the light-emitting cover 20 that extends into the avoidance section 12.

In this embodiment, the light-emitting cover 20 and the reflector 30 have a same opening shape of a consistent pattern, for example, the integral petal pattern shown in the diagram; and of course, the pattern may also be any other pattern. The reflector 30 has a light interception effect, and in cooperation with a same pattern of the top light-emitting cover 20, may present a decorative pattern on the light-emitting cover 20 in a lighting state, which increases decorativeness of the lighting fixture and improves the user experience.

With reference to FIG. 1, different from the above-described embodiment, in this embodiment, the light source assembly 40 further includes a sensing circuit 46 provided at the substrate 41, exposed through the reflector 30 and the light-emitting cover 20, and electrically connected with the drive circuit; and when the sensing circuit 46 is triggered, it triggers the drive circuit to supply power to the plurality of light sources 43.

More specifically, in this embodiment, central regions of the reflector 30 and the light-emitting cover 20 are correspondingly provided with sensing circuit avoidance sections; and the sensing circuit 46 sequentially passes through the sensing circuit avoidance section of the reflector 30 and the sensing circuit avoidance section of the light-emitting cover 20 to be exposed.

It should be noted that: if the lighting fixture does not need a sensing function, the sensing circuit 46 may be cancelled; accordingly, it is not necessary to form the sensing circuit avoidance sections in any of the light-emitting cover 20 and the reflector 30.

More specifically, in this embodiment, the sensing circuit 46 may include a light sensor (not shown); and the light sensor is triggered when the light brightness is sensed to be less than a predetermined threshold, so that the lighting fixture is lit when the light brightness is not high.

Figure 12B:
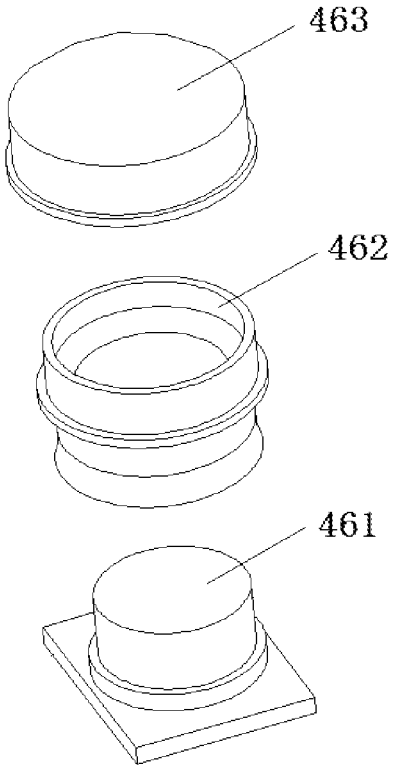
FIG. 12B is a schematic exploded view of a sensing circuit, according to an embodiment of the present disclosure.

FIG. 12B is a schematic exploded view of the sensing circuit according to the present disclosure. Further, in this embodiment, the sensing circuit 46 may further include an infrared detector 461, a lens 463 and a connecting socket 462; and the lens 463 is mounted above the infrared detector 461 through the connecting socket 462. The infrared detector 461 is triggered when the presence of heat is detected, and additionally, the light sensor is triggered when the light brightness is sensed to be less than a predetermined threshold, so that the lighting fixture is lit when the lighting fixture senses that the light brightness is less than a predetermined threshold and that there is someone passing; that is, the lighting fixture achieves an effect of "light-on when people is coming and light-off when people is leaving" in a dark environment, which is not only energy saving but also more humanized, so that the lighting fixture is used more and more widely in scenarios, for example, night activities, cabinets, corridors, passages, and so on.

Figure 6:
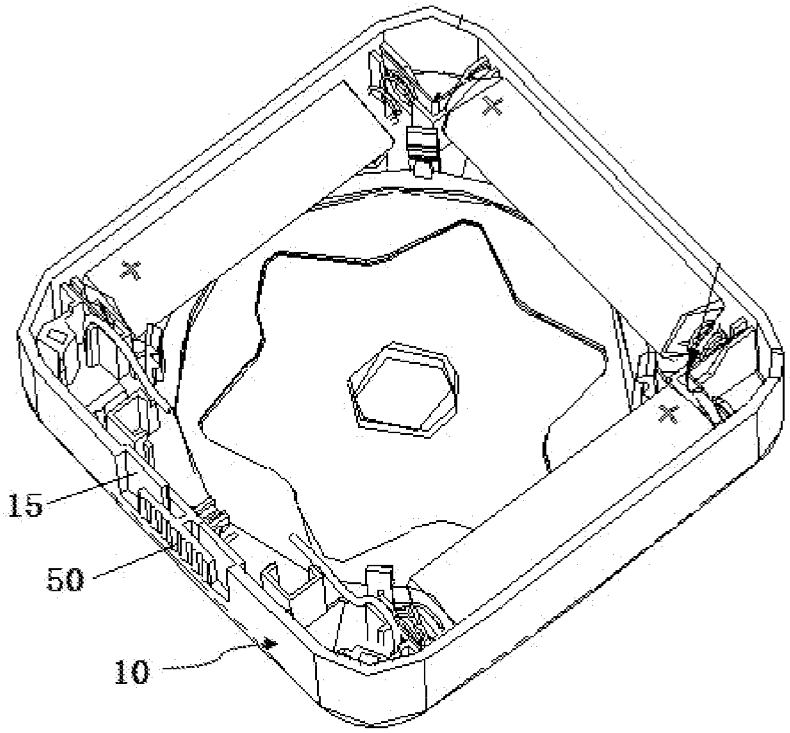
FIG. 6 is a schematic assembly diagram of the housing and a toggle, according to an embodiment of the present disclosure.
Figure 7A:
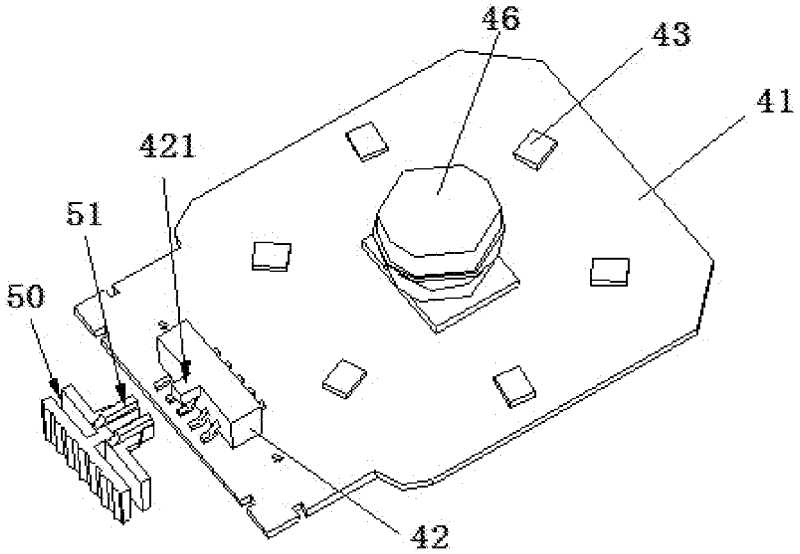
FIG. 7A is a schematic exploded view of the toggle and a substrate, according to an embodiment of the present disclosure.
Figure 7B:
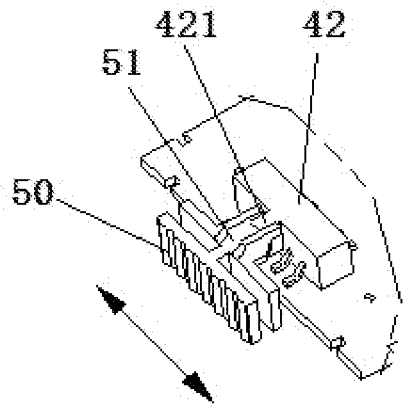
FIG. 7B is a schematic assembly diagram of the toggle and a switch, according to an embodiment of the present disclosure.

FIG. 6 is a schematic assembly diagram of the housing and a toggle according to the present disclosure. FIG. 7A is a schematic exploded view of the toggle and the substrate according to the present disclosure. FIG. 7B is a schematic assembly diagram of the toggle and a switch according to the present disclosure. As shown in FIG. 7A, this embodiment differs from the embodiment shown in FIG. 4A in that: the light source assembly 40 may further include a switch 42. The switch 42 is electrically connected with the drive circuit. The lighting fixture further comprises a toggle 50 which is provided on the housing 10 and can drive the switch 42 to move; the toggle 50 is slid to drive the switch 42 to slide, to control different lighting modes of the plurality of light sources 43. More specifically, as shown in FIG. 5, a chute 15 is provided at the sidewall 13 of the housing 10. More specifically, in this embodiment, the housing 10 is a square housing, wherein, the chute 15 is arranged at an intermediate position of one sidewall 13. As shown in FIG. 6, the toggle 50 is mounted at the chute 15 of the housing 10 and can be slid relative to the chute 15. More specifically, as shown in FIG. 7A, in one embodiment, the switch 42 has a switch handle 421 that protrudes outwardly. The toggle 50 has a switch slot 51. As shown in FIG. 7B, the switch handle 421 is accommodated by the switch slot 51, and the toggle 50 is slid to drive the switch 42 to slide, so as to control different lighting modes of the plurality of light sources 43. In other embodiments, the switch 42 and the toggle 50 may also be in a snap connection, a plug connection, or other fixed connection with each other.

Wherein, the lighting mode may be that some or all of the plurality of light sources 43 emit light, or may also be a combination of different color temperatures, for example, a first color temperature, a second color temperature, or the first color temperature plus the second color temperature, and so on.

In this embodiment, an ON/OFF action or a segmented dimming function of the lighting fixture is implemented through a configuration of combining the toggle 50 and the switch 42 in the present disclosure.

Figure 3B:
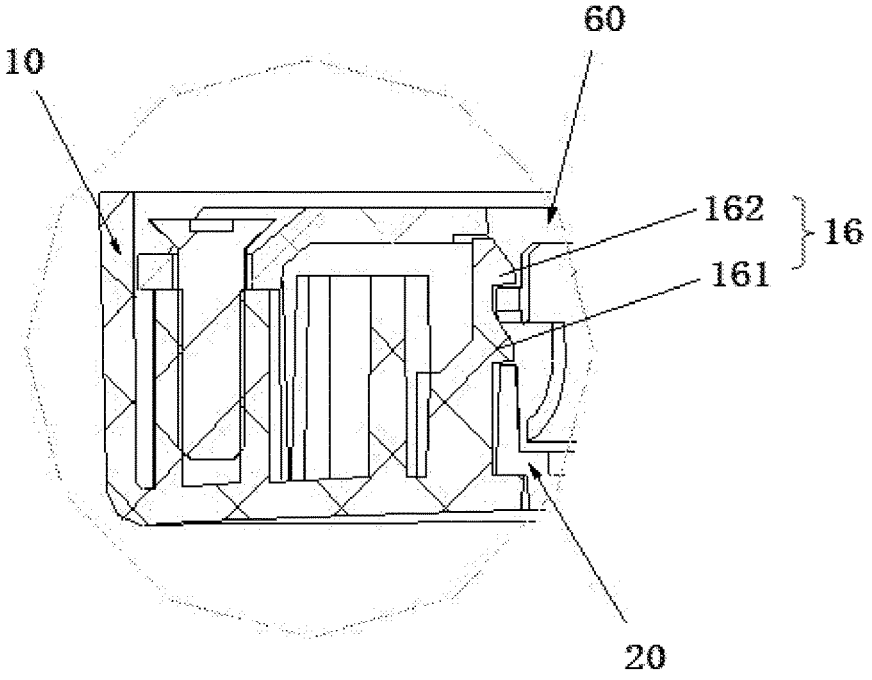
FIG. 3B is a schematic partial enlarged view of region B in FIG. 3A, according to an embodiment of the present disclosure.
Figure 8:
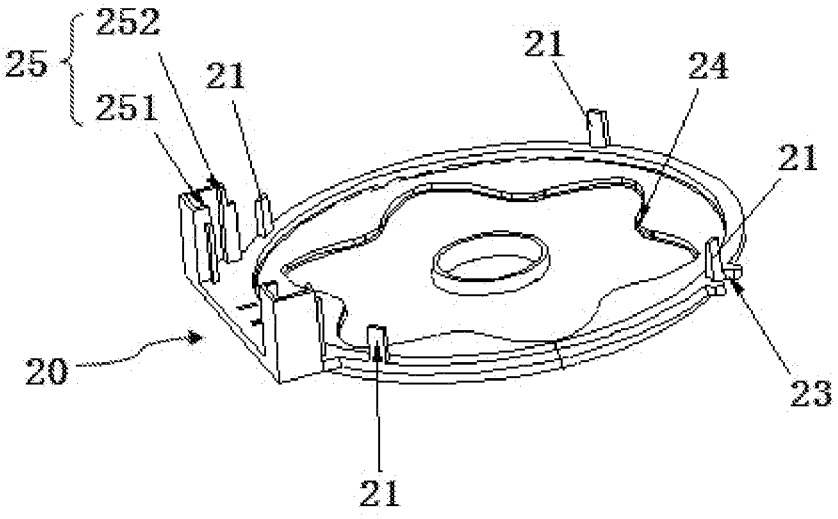
FIG. 8 is a schematic stereoscopic view of a back surface of a light-emitting cover, according to an embodiment of the present disclosure.
Figure 10:
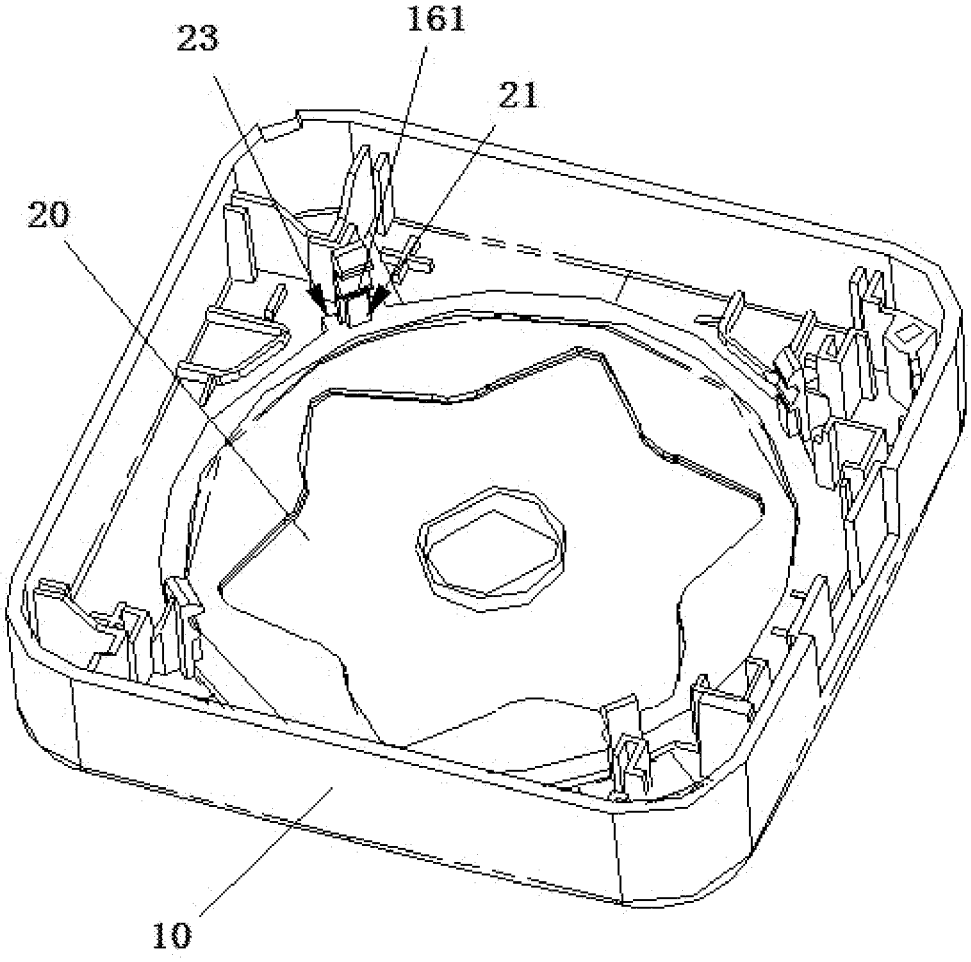
FIG. 10 is a schematic assembly diagram of the light-emitting cover and the housing, according to an embodiment of the present disclosure.
Figure 14:
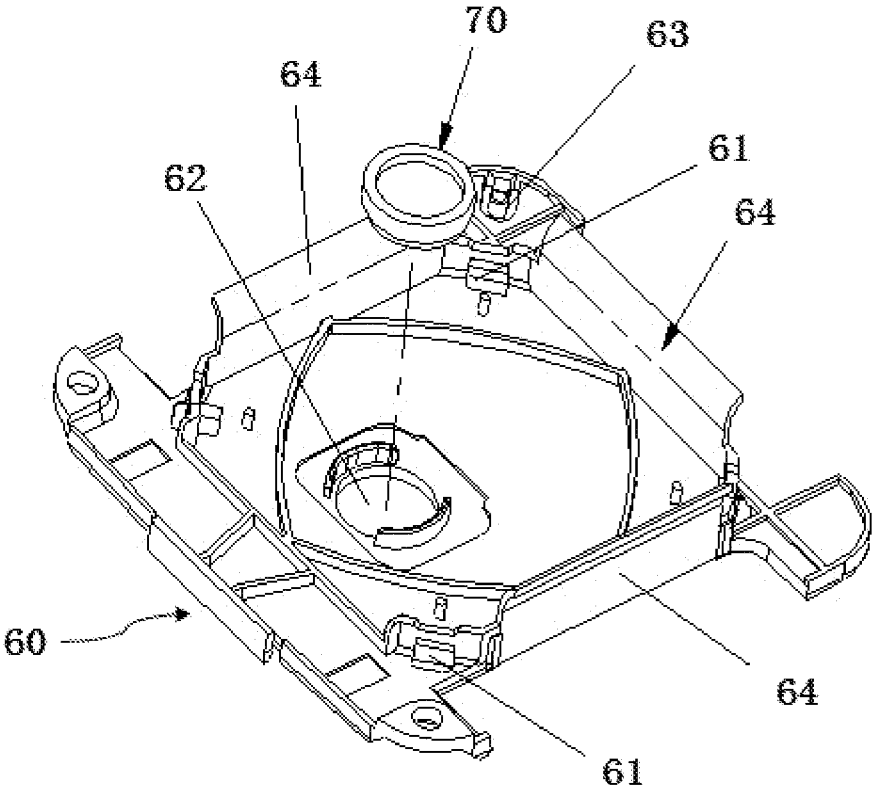
FIG. 14 is a schematic assembly diagram of a magnetic element and a bottom case, according to an embodiment of the present disclosure.

FIG. 3B is a schematic partial enlarged view of region B in FIG. 3A. FIG. 8 is a schematic stereoscopic view of a back surface of the light-emitting cover according to the present disclosure. FIG. 10 is a schematic assembly diagram of the light-emitting cover and the housing according to the present disclosure. FIG. 14 is a schematic assembly diagram of a magnetic element and the bottom case according to the present disclosure. As shown in FIG. 5, also with reference to FIG. 3B, the housing 10, the light-emitting cover 20 and the bottom case 60 are snap-fitted to one another. More specifically, the housing 10 is provided with a double snap 16 including a first snap 161 and a second snap 162 having different heights, wherein, the first snap 161 and the second snap 162 are respectively snap-fitted to the housing 10 and the bottom case 60.

In this embodiment, the lower end face 11 of the housing 10 has a front surface and a back surface: one exposed surface of the lower end face 11 is the front surface, and the other opposite surface is the back surface; four double snaps 16 are provided at intervals on the back surface of the lower end face 11 of the housing 10 at positions close to a periphery of the avoidance section 12; and each double snap 16 includes a first snap 161 and a second snap 162 from bottom to top. Of course, the number of double snaps 16 may also be one, two, three, five, and so on. Screw-holes are arranged at a periphery of the housing 10, which cooperate with screws to fix the housing 10 to the bottom case 60.

As shown in FIG. 8, also with reference to FIG. 10, the light-emitting cover 20 is a plate-shaped body; the light-emitting cover 20 has a front surface and a back surface: one surface of the light-emitting cover 20 that extends from the avoidance section 12 is the front surface, and the other opposite surface is the back surface. Four upright posts 21 which are perpendicular to the back surface and protrude outwardly are provided on the back surface at positions corresponding to the four double snaps 16 (with reference to FIG. 5) in the housing 10. Of course, the number of upright posts 21 may also be one, two, three, five, and so on. As shown in FIG. 9, a step 22 is provided at a periphery of the front surface of the light-emitting cover 20.

As shown in FIG. 14, the bottom case 60 is a plate-shaped body, and the housing 10 has a front surface and a back surface: one exposed surface of the housing 10 is the front surface, and the other opposite surface is the back surface. Four outer protrusions are provided on the back surface of the bottom case 60 at positions corresponding to the four double snaps 16 in the housing 10, and each outer protrusion is perforated with a snap section 61 parallel to the back surface. Of course, the numbers of outer protrusions and snap sections may also be one, two, three, five, and so on. A screw via hole is provided in the bottom case 60, and a screw is fastened with the housing 10 through the screw via hole.

When mounted, referring to FIG. 9, the light-emitting cover 20 is mounted at the avoidance section 12 (with reference to FIG. 5) of the housing 10 through the step 22; and the step 22 may abut against the avoidance section 12 of the housing 10 (with reference to FIG. 5). With reference to FIG. 10, also with reference to FIG. 3B, the four upright posts 21 in the light-emitting cover 20 abut against the first snaps 161 of the corresponding double snaps 16 in the housing 10. With reference to FIG. 3B, the second snaps 162 of the four double snaps 16 in the housing 10 are correspondingly clamped in the corresponding snap sections 61 in the bottom case 60.

It should be noted that, the double snap 16 in the housing 10 may be substituted by a single snap, in this case, the bottom case 60 is not provided with any snap section 61, and the bottom case 60 may also be assembled with the housing assembly 1 by fastening screws at the periphery of the bottom case 60.

As compared with the previous embodiment, as shown in FIG. 8, in this embodiment, the periphery of the light-emitting cover 20 is provided with two outer protrusions spaced apart from each other; a limit slot 23 is formed between the two outer protrusions; and as shown in FIG. 10, when mounted, the limit slot 23 is clamped at a double snap 16 in the housing 10, so as to prevent the light-emitting cover 20 from moving horizontally while the light-emitting cover 20 is snapped into the avoidance section 12 of the housing 10.

Figure 11:
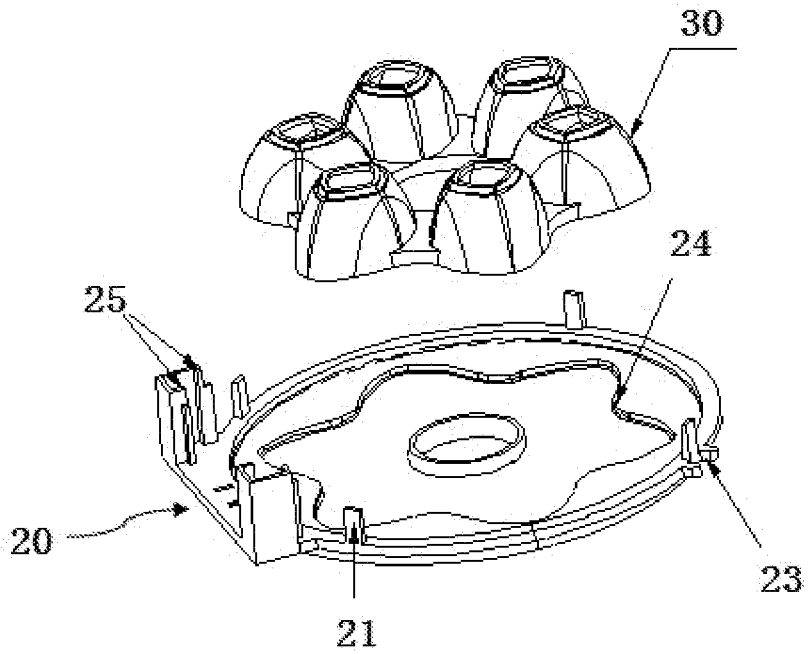
FIG. 11 is a schematic exploded view of the reflector and the light-emitting cover, according to an embodiment of the present disclosure.

FIG. 11 is a schematic exploded view of the reflector and the light-emitting cover according to the present disclosure. As shown in FIG. 8, also with reference to FIG. 11, as compared with the above-described embodiment, in this embodiment, a groove 24 corresponding to an outer contour of the reflector 30 is provided on the back surface of the light-emitting cover 20. As shown in FIG. 11, when mounted, one side of the reflector 30 on which the light emergent port 322 is located is mounted in the groove 24 of the light-emitting cover 20, so as to restrict movement of the reflector 30 in a horizontal direction.

FIG. 13 is a schematic assembly diagram of the light source assembly, the reflector and the light-emitting cover according to the present disclosure. As shown in FIG. 8, also with reference to FIG. 13, as compared with the above-described embodiment, in this embodiment, a peripheral portion of the back surface of the light-emitting cover 20 extends outward; a corner portion at the extension position is provided with a positioning bone 25 protruding outward and being perpendicular to the back surface; and more specifically, the positioning bone 25 includes a lateral positioning bone 251 and a longitudinal positioning bone 252 that are one-piece structure. As shown in FIG. 12, the corner portion of the substrate 41 is provided with a clamp slot corresponding to the positioning bone 25 of the light-emitting cover 20. In this embodiment, the clamp slot includes a first clamp slot 44 and a second clamp slot 45 respectively corresponding to the lateral positioning bone 251 and the longitudinal positioning bone 252. As shown in FIG. 13, when mounted, the first clamp slot 44 of the substrate 41 is clamped into the lateral positioning bone 251 of the light-emitting cover 20, and the second clamp slot 45 of the substrate 41 is clamped into the longitudinal positioning bone 252 of the light-emitting cover 20, so as to restrict movement of the substrate 41 in the horizontal direction.

More specifically, in this embodiment, two groups of positioning bones 25 are provided in the light-emitting cover 20, and two groups of first clamp slots 44 and second clamp slots 45 are also provided in the corresponding substrate 41. It should be noted that, the substrate 41 in FIG. 12 may also be provided with one group of first clamp slots 44 and second clamp slots 45 at the corner portion.

As shown in FIG. 14, in this embodiment, the bottom case assembly 2 further includes a magnetic element 70; and the magnetic element 70 adsorbs an iron mounting board to implement adsorption mounting of the lighting fixture. The bottom case 60 is a plate-shaped body; the bottom case 60 is provided therein with the magnetic element perforating in an axial direction; and the magnetic element corresponds to an accommodating portion 62. When mounted, the magnetic element 70 is embedded into the magnetic element accommodating portion 62 of the bottom case 60. In this embodiment, the magnetic element 70 is a magnet, and of course the magnetic element 70 may also be any other magnetic element.

Figure 15:
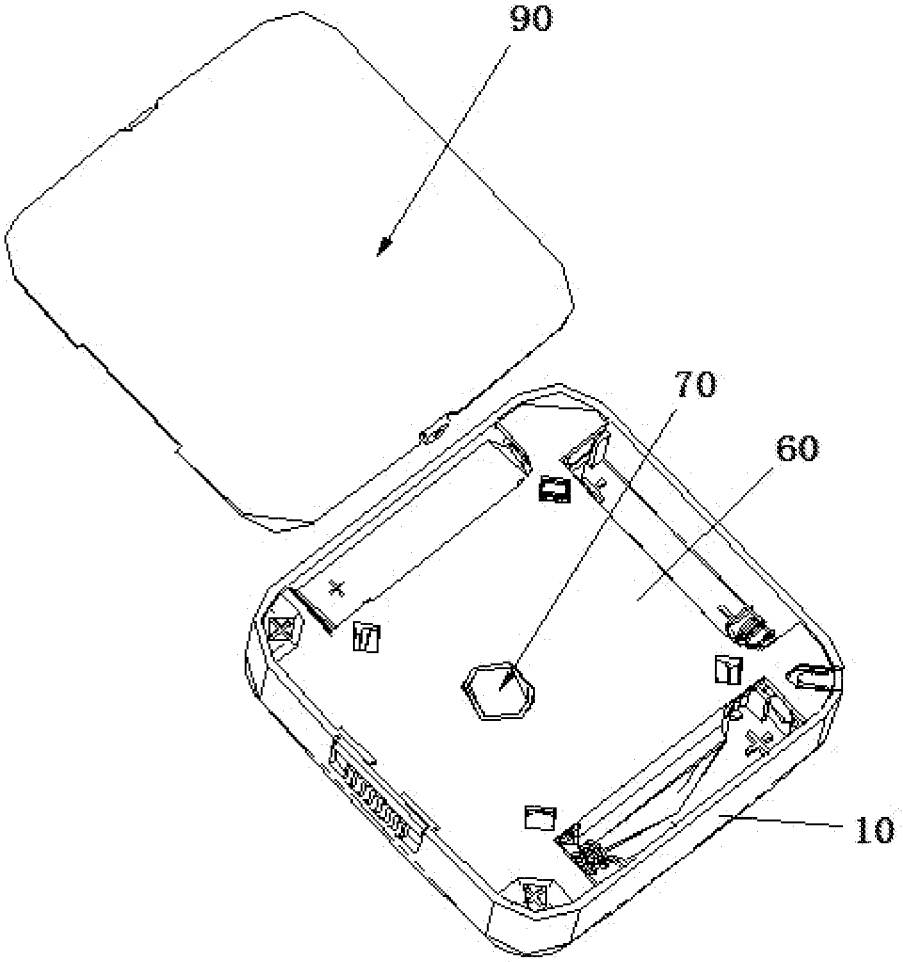
FIG. 15 is a schematic exploded view of the lighting fixture with the backplane, according to an embodiment of the present disclosure.

FIG. 15 is a schematic exploded view of the lighting fixture with the backplane according to the present disclosure. In this embodiment, the bottom case assembly 2 further includes a backplane 90 covering above the bottom case 60 and adsorbed by the magnetic element 70. In this embodiment, the backplane 90 is an iron backplane; and in other embodiments, it may also be other backplane adsorbed by the magnetic element 70, such as a nickel backplane and a cobalt backplane, and of course, may also be a backplane of other material.

Figure 16A:
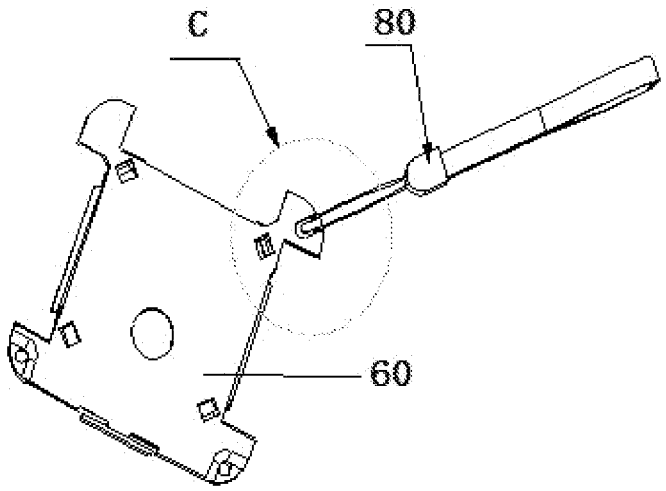
FIG. 16A is a schematic assembly diagram of a lanyard and the bottom case, according to an embodiment of the present disclosure.
Figure 16B:
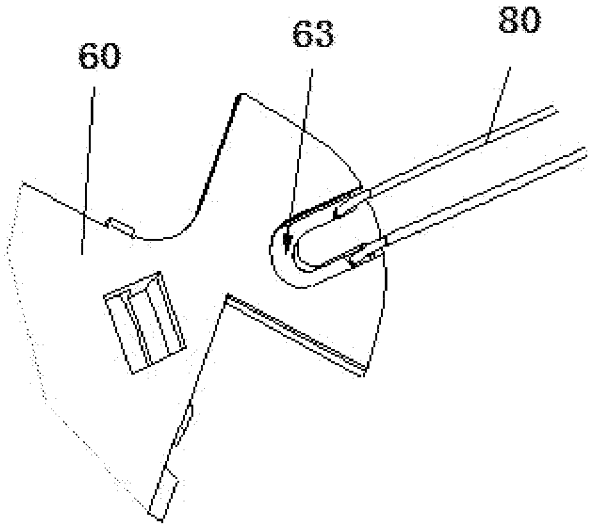
FIG. 16B is a partial enlarged view of region C in FIG. 16A, according to an embodiment of the present disclosure.

FIG. 16A is a schematic assembly diagram of a lanyard and the bottom case according to the present disclosure. FIG. 16B is a partial enlarged view of region C in FIG. 16A. As shown in FIG. 16A, also with reference to FIG. 16B, in this embodiment, the bottom case assembly 2 further includes a lanyard 80, and is suspended at a hook through the lanyard 80 to implement suspension mounting of the lighting fixture. The bottom case 60 is a plate-shaped body, and a corner portion of the bottom case 60 is provided with a lanyard section 63. When mounted, the lanyard 80 runs through the lanyard section 63 of the bottom case 60. Of course, in other embodiments, the housing assembly 1 may further include a lanyard, and accordingly, the housing 10 has a lanyard section therein.

As shown in FIG. 1, in this embodiment, the bottom case assembly 2 further includes a back glue sheet 100, and is pasted on a mounting surface through the back glue sheet 100 to implement paste mounting of the lighting fixture. When mounted, the back glue sheet 100 respectively sticks to the bottom case 60 and the mounting surface.

More specifically, in this embodiment, the magnetic element 70, the lanyard 80, the iron backplane 90 and the back glue sheet 100 may be included, so as to implement adsorption mounting, suspension mounting and paste mounting of the lighting fixture, so that mounting modes of the lighting fixture are diversified to adapt to more mounting scenes, and the lighting fixture is used very conveniently.

Figure 17:
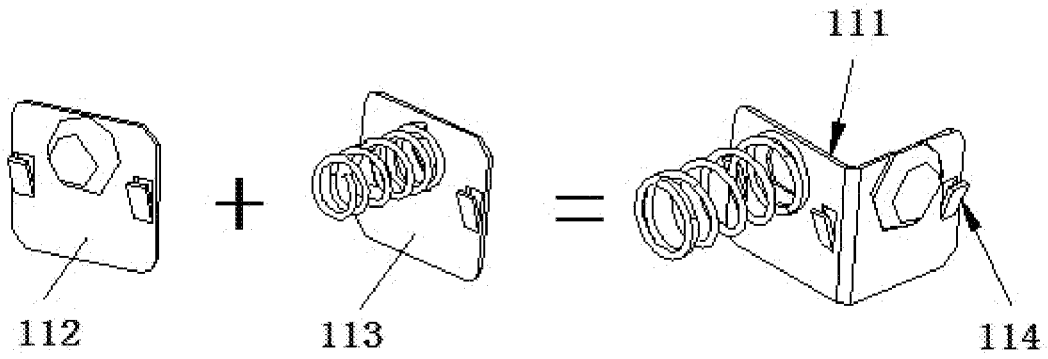
FIG. 17 is a schematic stereoscopic view of an integral elastic piece, according to an embodiment of the present disclosure.
Figure 18:
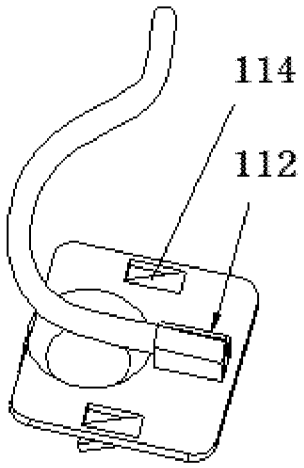
FIG. 18 is a schematic stereoscopic view of a positive electrode elastic piece, according to an embodiment of the present disclosure.
Figure 19:
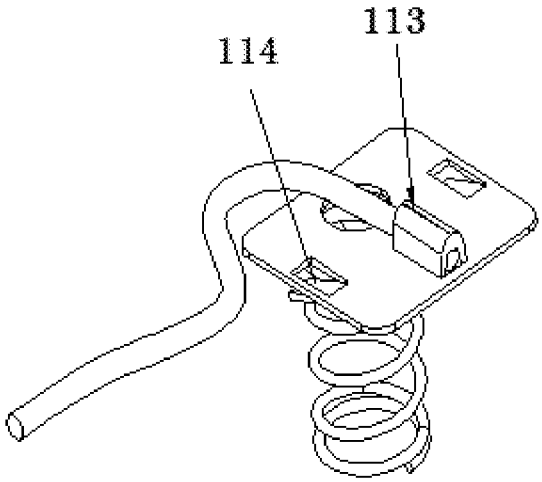
FIG. 19 is a schematic stereoscopic view of a negative electrode elastic piece, according to an embodiment of the present disclosure.
Figure 20:
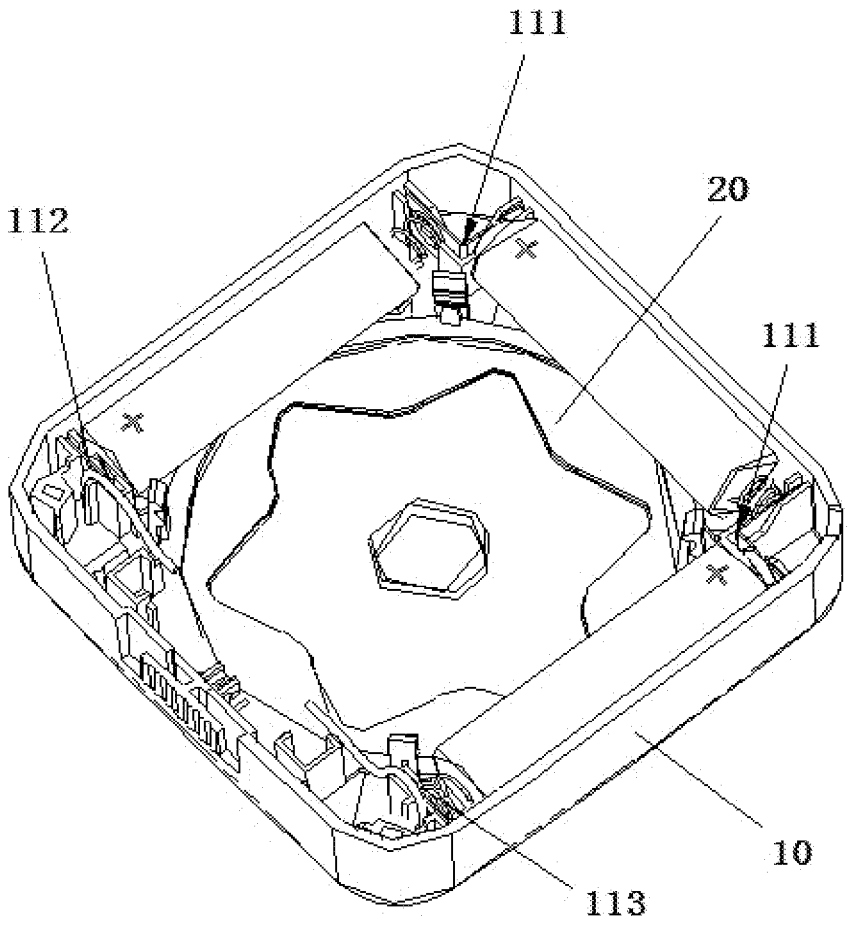
FIG. 20 is a schematic assembly diagram of the housing, the light-emitting cover, the electrode elastic pieces and a battery, according to an embodiment of the present disclosure.

FIG. 17 is a schematic stereoscopic view of an integral elastic piece according to the present disclosure. FIG. 18 is a schematic stereoscopic view of a positive electrode elastic piece according to the present disclosure. FIG. 19 is a schematic stereoscopic view of a negative electrode elastic piece according to the present disclosure. FIG. 20 is a schematic assembly diagram of the housing, the light-emitting cover 20, the electrode elastic pieces 110 and a battery according to the present disclosure. With reference to FIG. 1, in this embodiment, the housing assembly 1 further includes at least one group of electrode elastic pieces 110 for electrically conducting with the battery. With reference to FIG. 1, the electrode elastic pieces 110 are electrically connected with the light source assembly 40, and the battery supplies power to the light source assembly 40 through the electrode elastic pieces 110.

In this embodiment, the electrode elastic pieces 110 are provided for mounting the battery which can supply power, so a wiring arrangement does not need to be considered and a use occasion is not limited, which allows application to a scene where it is not convenient for arranging wirings, and particularly, to places such as corridors, passages and wardrobes, which are not convenient for arranging wirings.

More specifically, in this embodiment, the electrode elastic pieces 110 surround the sidewall 13 and are located on an outer periphery of the light-emitting cover 20. The electrode elastic pieces 110 include: an integral elastic piece 111 (with reference to FIG. 17) having a positive electrode and a negative electrode, a positive electrode elastic piece 112 (with reference to FIG. 18) and a negative electrode elastic piece 113 (with reference to FIG. 19); and all the electrode elastic pieces 110 are electrically connected with the light source assembly 40 (with reference to FIG. 1). As shown in FIG. 5, elastic piece slots 17 corresponding to the integral elastic piece 111 (with reference to FIG. 17A), the positive electrode elastic piece 112 (with reference to FIG. 18), and the negative electrode elastic piece 113 (with reference to FIG. 19) are formed in the sidewall 13 of the mounting space 14 of the housing 10. The integral elastic piece 111 (with reference to FIG. 17), the positive electrode elastic piece 112 (with reference to FIG. 18) and the negative electrode elastic piece 113 (with reference to FIG. 19) are correspondingly provided with barbs 114. As shown in FIG. 20, when mounted, the integral elastic piece 111, the positive electrode elastic piece 112 and the negative electrode elastic piece 113 are inserted into the corresponding elastic piece slots 17, and are fixed to the corresponding elastic piece slots 17 by corresponding barbs 114 thereon; the battery supplies power to the light source assembly 40 through the electrode elastic pieces 110. A battery mounting cavity is provided in a peripheral of the mounting space 14 of the housing 10 and cooperates with the elastic piece slots 17 to complete mounting of the battery. More specifically, as shown in FIG. 14, a battery avoidance region 64 is provided in the bottom case 60 at a position corresponding to the battery.

More specifically, the integral elastic piece 111 according to this embodiment is specifically arranged at two corners of the housing 10. The integral elastic piece 111 is an integrated elastic piece with two polarities; in this embodiment, wirings are riveted with the elastic piece by a riveter to implement a circuit connection; and the above-described process and structure not only improves production efficiency and reduces costs, but also avoids a risk of unreliable connection caused by site welding.

It should be noted that, the positive electrode elastic piece 112, the negative electrode elastic piece 113 and the integral elastic piece 111 at the corner may all be manually welded at the site.

With reference to FIG. 1, the battery of the lighting fixture of the present disclosure is easy to install and replace:

Installing the battery: uncovering the iron backplane 90 and inserting the battery into the battery cavity.

Replacing the battery:

1) Paste mounting: the housing assembly 1 and the bottom case assembly 2 are adsorbed with the iron backplane 90 by the magnetic element 70, so a user only needs to firstly take down the lighting fixture comprising the housing assembly 1 and the bottom case assembly 2, then remove an old battery and install a new battery, and then absorb the light onto the iron backplane 90.

2) Mounting with the lanyard 80: taking down the lighting fixture from the hook, uncovering the iron backplane 90, installing the battery into the battery cavity, then covering the iron backplane 90, and finally hanging the lighting fixture on the hook.

3) Absorption mounting: directly taking down the lighting fixture, replacing the battery and then absorbing back. Because there is no iron backplane 90, replacement is more convenient.

In the specification provided herein, numerous specific details are explained. However, it may be understood that the embodiments of the present disclosure may be practiced without these specific details. In some embodiments, well-known methods, structures and technologies are not shown in detail so as not to obscure the understanding of the present specification.

Similarly, it should be understood that, in order to streamline the present disclosure and help to understand one or more of the respective aspects, in the above description of the exemplary embodiments of the present disclosure, the respective features of the present disclosure are sometimes grouped together into a single embodiment, diagram, or description thereof. However, the disclosed method should not be interpreted as reflecting an intention below: more features than those explicitly recorded in each claim are claimed in the present disclosure for which protection is claimed. More specifically, as reflected in the following claims, the inventive aspects are fewer than all the features of the previously disclosed single embodiment. Therefore, the claims that follow the specific implementation modes are explicitly incorporated into the specific implementation modes, wherein, each claim itself is taken as a separate embodiment of the present disclosure.

Those skilled in the art may understand that, the modules in the device according to the embodiment may be adaptively changed and provided in one or more devices different from that according to this embodiment. The modules or the units or the components according to the embodiment may be combined into one module or unit or component, and further they may be divided into a plurality of sub-modules or sub-units or sub-components. All features disclosed in the present specification (including the claims, the abstract and the drawings appended), and all processes or units of any method or any device so disclosed in the present specification may be combined in any combination mode, except at least some of the features and/or the processes or the units that are mutually exclusive. Unless otherwise stated clearly, each feature disclosed in the present specification (including the claims, the abstract and the drawings appended) may be replaced by an alternative feature that provides a same, equivalent or similar purpose.

In addition, those skilled in the art can understand that, although some embodiments described herein include some certain features included in other embodiments other than other features, yet a combination of features of different embodiments are intended to be within the scope of the present disclosure and to form different embodiments. For example, in the claims, any one of the claimed embodiments may be used in any combination mode.

It should be noted that, the above-described embodiments are illustrative of the present disclosure and are not intended to limit the scope of the present disclosure, and those skilled in the art may devise alternative embodiments without departing from the scope of the appended claims. In the claims, any reference sign placed between parentheses shall not be construed as a limitation to the claims. The word "comprising" does not exclude presence of elements or steps that are not recited in the claims. The word "a" or "an" located in front of an element does not exclude presence of a plurality of such elements. The present disclosure may be implemented by means of hardware including a plurality of different elements, and by means of a suitably programmed computer. In unit claims enumerating a plurality of devices, several of these devices may be embodied via a same hardware item. The use of words such as first, second and third does not indicate any order, and these words may be interpreted as names.

So far, it should be recognized by those skilled in the art that, although a plurality of exemplary embodiments of the present disclosure have been shown and described in detail herein, many other transformations or modifications that conform to the principles of the present disclosure may still be directly determined or derived from the contents disclosed by the present disclosure without departing from the spirit and scope of the present disclosure. Therefore, the scope of the present disclosure should be understood and confirmed as covering all the other transformations or modifications.

What is claimed is:

1. A lighting fixture, comprising:

a housing assembly, comprising:

a housing, at least comprising a lower end face and a sidewall extending vertically from the lower end face, to provide a mounting space; the lower end face being provided with an avoidance section perforating the lower end face in an axial direction and communicating with the mounting space;

a light-emitting cover, a reflector and a light source assembly, which are superposed in the mounting space in an order from bottom to top; the light-emitting cover being fixedly connected with the housing; and the light-emitting cover abutting against the lower end face and at least partially closing the avoidance section; and a bottom case assembly, comprising a bottom case, the bottom case being located above the light source assembly, assembled with the housing, and fixedly connected with the housing to be compressed together tightly and collectively accommodate the reflector and the light source assembly as well as the light-emitting cover, wherein the housing is provided with a plurality of double snaps at intervals on a back surface of the lower end face of the housing at positions close to a periphery of the avoidance section;

wherein upright posts are provided on the back surface of the light-emitting cover at positions corresponding to the plurality of double snaps, the upright posts being perpendicular to the back surface and protruding outwardly; and wherein snap sections perforating and parallel to the back surface are provided in the back surface of the bottom case at positions corresponding to the plurality of double snaps in the housing.

2. The lighting fixture according to claim 1, comprises a light emergent port, and a sidewall; the sidewall enclosing an optical space in communication with the light incident port and the light emergent port; and a sidewall of at least one sub-reflector being connected with the central connecting part;

wherein the light source assembly comprises:

a substrate, a drive circuit; and a plurality of light sources, provided on the substrate and electrically connected with the drive circuit; and wherein a light incident port of at least one sub-reflector accommodates at least one light source.

3. The lighting fixture according to claim 2, wherein the sidewall of the sub-reflector is disposed by adjoining a plurality of curved surfaces;

wherein an intersection edge is disposed between adjacent two curved surfaces; and wherein at least two of the intersection edges intersect with an edge of the light emergent port and an edge of the light incident port, to respectively dispose at least two intersection points at the edge of the light emergent port and the edge of the light incident port.

4. The lighting fixture according to claim 2, wherein the reflector further comprises a plurality of connecting posts; and wherein at least one sub-reflector is connected with an adjacent sub-reflector through a corresponding connecting post.

5. The lighting fixture according to claim 2, wherein the light-emitting cover is provided with a pattern disposed with a shape of an opening of the reflector.

6. The lighting fixture according to claim 1, wherein the light source assembly comprises:

a substrate;

a drive circuit; and a plurality of light sources, provided on the substrate and electrically connected with the drive circuit; and wherein the light source assembly further comprises a sensing circuit, provided at the substrate, exposed through the center opening and the light-emitting cover, and electrically connected with the drive circuit; and wherein the sensing circuit, when triggered, triggers the drive circuit to supply power to the plurality of light sources.

7. The lighting fixture according to claim 6, wherein the sensing circuit comprises a light sensor;

wherein the light sensor is triggered when light brightness is sensed to be less than a predetermined threshold; and wherein the lighting fixture is lit when the light brightness is not high.

8. The lighting fixture according to claim 7, wherein the sensing circuit further comprises an infrared detector;

wherein the infrared detector is triggered when a presence of heat is detected; and wherein the lighting fixture is lit when the lighting fixture senses that the light brightness is less than a predetermined threshold and that there is someone passing.

9. The lighting fixture according to claim 8, wherein the sensing circuit further comprises a lens and a connecting socket; and wherein the lens is mounted above the infrared detector through the connecting socket.

10. The lighting fixture according to claim 1, wherein the light source assembly comprises:

a substrate;

a drive circuit;

a plurality of light sources, provided on the substrate and electrically connected with the drive circuit; and a switch, electrically connected with the drive circuit;

wherein the lighting fixture further comprises a toggle provided on the housing, the toggle driving the switch to move; and wherein the toggle being slid to drive the switch to slide, to control different lighting modes of the plurality of light sources.

11. The lighting fixture according to claim 1, wherein the housing, the light-emitting cover, and the bottom case are snap-fitted to one another.

12. The lighting fixture according to claim 11, wherein the housing is provided with a double snap comprising a first snap and a second snap having different heights; and wherein the first snap and the second snap are respectively snap-fitted to the housing and the bottom case.

13. The lighting fixture according to claim 1, wherein the light-emitting cover and the light source assembly are snap-fitted to each other.

14. The lighting fixture according to claim 1, wherein the bottom case assembly further comprises a magnetic element; and the magnetic element adsorbs an iron mounting board to implement adsorption mounting of the lighting fixture.

15. The lighting fixture according to claim 14, wherein the bottom case is a plate-shaped body, and the bottom case is provided with a magnetic element accommodating portion perforating in an axial direction; and wherein when mounted, the magnetic element is embedded into the magnetic element accommodating portion of the bottom case.

16. The lighting fixture according to claim 1, wherein the bottom case assembly or the housing assembly further comprises a lanyard, and is hung on a hook through the lanyard to implement suspension mounting of the lighting fixture.

17. The lighting fixture according to claim 1, wherein the bottom case assembly further comprises a back glue sheet, and is pasted on a mounting surface through the back glue sheet to implement paste mounting of the lighting fixture; and wherein when mounted, the back glue sheet respectively sticks to the bottom case and the mounting surface.

18. The lighting fixture according to claim 1, wherein the housing assembly further comprises at least one group of electrode elastic pieces for electrically conducting with a battery;

wherein the electrode elastic pieces are electrically connected with the light source assembly, and the battery supplies power to the light source assembly through the electrode elastic pieces.

19. The lighting fixture according to claim 18, wherein the electrode elastic pieces surround the sidewall and are located on an outer periphery of the light-emitting cover; and wherein a battery avoidance region is provided in the bottom case at a position corresponding to the battery.

* * * * *